United States Patent [19]

Mahar

[11] 4,113,569

[45] Sep. 12, 1978

[54] COKE AIR POLLUTION CONTROL METHOD AND APPARATUS

[75] Inventor: Kevin D. Mahar, Buffalo, N.Y.

[73] Assignee: Donner-Hanna Coke Corporation, Buffalo, N.Y.

[21] Appl. No.: 635,594

[22] Filed: Nov. 28, 1975

[51] Int. Cl.[2] ..... C10B 33/00; C10B 39/00

[52] U.S. Cl. ..... 201/39; 55/257 PV; 55/385 R; 202/227; 202/263

[58] Field of Search ..... 201/39; 202/262, 263, 202/227; 55/257 PV, 385 R

[56] References Cited

U.S. PATENT DOCUMENTS

| | | | |
|---|---|---|---|
| 808,897 | 1/1906 | Carrier | 55/257 PV |
| 1,838,255 | 12/1931 | Handelan | 55/257 PV X |
| 3,517,486 | 6/1970 | Golden | 55/257 PV X |
| 3,676,305 | 7/1972 | Cremer | 202/263 |
| 3,785,933 | 1/1974 | Edgar et al. | 202/263 |
| 3,801,472 | 4/1974 | Kemmetmueller | 202/227 X |
| 3,801,473 | 4/1974 | Schoen et al. | 202/263 |
| 3,843,461 | 10/1974 | Allen | 202/263 X |
| 3,846,250 | 11/1974 | Knappstein et al. | 201/39 |
| 3,869,352 | 3/1975 | Allen et al. | 202/263 X |
| 3,966,563 | 6/1976 | Armour et al. | 202/263 X |

FOREIGN PATENT DOCUMENTS

| | | | |
|---|---|---|---|
| 2,326,630 | 12/1974 | Fed. Rep. of Germany | 202/263 |

*Primary Examiner*—Morris O. Wolk
*Assistant Examiner*—Arnold Turk
*Attorney, Agent, or Firm*—Christel & Bean

[57] ABSTRACT

Retrofit method and apparatus for minimizing the emission of particulate-laden smoke to the ambient atmosphere during the movement of slot-oven-produced, incandescent coke prior to the time it is quenched in an open-topped rail vehicle.

A cyclically used, moveable hood is selectively positioned around and over a guide through and from which extruded, incandescent coke drops into an open-top vehicle which concurrently is moving at right angles to the path of the extruding coke. The hood confines potentially air polluting emissions during extrusion. Use is made of the latent heat in the extruded, incandescent coke to make steam out of water introduced within the hood from a plurality of water sprays so as to create a substantial steam atmosphere which envelopes the coke and thereby suppresses combustion when it would otherwise be most extensive. Further, the steam atmosphere is used to screen and protect the apparatus from excessive radiant heat and thereby protect its integrity.

Limited quantities of exhaust steam are vented through a low-differential gas cleaner so as to remove most of the particulates which represent the residuum after suppressive control effects of both the hood and the steam envelope. The suppressive emission control effect of the method and apparatus continues as incandescent coke, reposing within a vehicle, is conveyed to a remote location for reduction of the whole contents of the car below its autoignition temperature.

16 Claims, 3 Drawing Figures

10
28
28b
28d
38
12
14
22a
22
34
28c
40
36
28a
36a
16
18
22c
24
3
22b
28e
22a

COKE AIR POLLUTION CONTROL METHOD AND APPARATUS

BACKGROUND OF THE INVENTION

The present invention relates generally to a method and apparatus for minimizing the emission of particulate-laden smoke to the ambient atmosphere prior to the final quenching of incandescent coke. More specifically, the present invention discloses a method and apparatus for suppressing combustion of incandescent coke upon its extrusion from a slot type oven and for avoiding the emission of that amount of particulate matter which otherwise would be drawn into the thermal updraft created by the incandescent coke.

The ever-increasing concern over environmental pollution has focused on a number of industrial operations that emit substantial amounts of gaseous and particulate materials to the ambient atmosphere. Various gas-cleaning devices have been employed to capture such emissions such as electrostatic precipitators, scrubbers, etc. However, such devices have generally been applicable for use only in conjunction with fixed or stationary collecting structures. Thus, there is a need for such systems that may be employed wherein vehicular operations are encountered, at least in part, and which require emission control.

One particular industrial operation producing substantial gaseous and particulate emissions is the movement of incandescent coke from a slot oven and the conveyance of such incandescent coke to a remotely located quenching station whereby the coke is cooled for subsequent use, for example in iron production. Typically, coke is pushed or extruded from any one of several individual oven chambers in a slot-type battery into a moveable guide by which the coke is constrained to fall into an open-top railroad vehicle while it is moving past a loading point adjacent to the coke oven. As the coke emerges from the oven, the gaseous and particulate emissions are relatively minor until the coke begins to break up as it leaves the coke guide to drop into the vehicle thereunderneath. This extruding and falling normally results in the generation of a substantial quantity of sooty smoke and other particulate matter of the type that pollutes the ambient air and atmosphere, and emissions may continue while the vehicle travels. Both the emission intensity and duration are expected to be greatest where the battery is older and in need of retrofit controls because the pyrolysis of coal to coke is more erratic in such production entities.

Thereafter, the filled vehicle is then moved to a quenching station located remotely from the coke oven wherein the coke deployed along the bottom of the vehicle is heavily sprayed with water to quench the same.

Although the prior art has considered various hood constructions for controlling coke emissions upon its extrusion into an open-topped vehicle, such prior art hoods simply cover the coke guide and underlying vehicle in an attempt to collect the thermal updraft and entrained emissions during breaking of the coke as it falls into the receiving car. However, temperatures developed during such extrusion of the coke are substantial which can lead to the structural failure of such collectors and their associated ducting to gas cleaners and consequently only result in a minimum control of pollutants passing to the atmosphere.

In addition, the prior art has attempted to construct, in effect, vehicular quenching stations communicating with the coke guide whereby the coke is either quenched immediately subsequent to its extrusion or is subjected to quenching operations during its conveyance away from the coke guide as by transitory quenching equipment assembled on a vehicle so as to move therewith. However, these prior art structures render useless the substantial number of open-topped vehicle quenching installations utilized in the industry which are remotely located from coke ovens.

It is in this regard of devising a method and apparatus for not only controlling coke emissions during its extrusion into an open-topped vehicle but also during conveyance of the coke in such a vehicle to remotely situated quenching stations that the present invention is considered most important. Those knowledgeable in coke-producing operations are aware of the fact that often times on older ovens portions of incompletely carbonized coal are pushed from a coke oven into an open-topped vehicle. This is known as a so-called "green push". Unlike completely carbonized coke, which generates particulate emissions only during the coke oven push and during the quenching, a "green push" will emit substantial emissions during the whole time interval for movement between the coke oven and quenching station. The method and apparatus of the instant invention controls emissions of a "green push" during the period of time when the coke is being extruded and subsequently until the coke is quenched, thus offering a substantial advantage over prior systems. Such control is accomplished without complex conveyance equipment as used in some prior art methods which are, in effect, vehicles specially designed for receiving, transporting, quenching and discharging incandescent or newly-quenched coke.

SUMMARY OF THE INVENTION

Accordingly, one object of the present invention is to provide a method and apparatus for effectively controlling air polluting emissions from incandescent coke during its initial extrusion from a slot-type oven and during its conveyance in an open-topped rail vehicle from coke oven to quenching station.

Another object of the present invention is to provide an apparatus and method for controlling the emissions described hereinabove which are operable with prior art coke processing faciliities having a coke quenching station remotely located from a coke oven and connected by standard gauge rail trackage on which are operated open-top, side-dump, self-unloading cars.

A still further object of the present invention is to provide the method and apparatus referred to hereinabove which may be employed in a reliable and economical manner without the need for substantial amounts of excessive equipment and air-handling machinery. Along with avoiding the initial cost penalty associated with excessive size and complexity, energy consumption is minimized and percentage of time in operation is maximized in the present invention.

In summary, the subject method includes the provision of an enclosure over the coke guide and the adjacent portion of the coke admitting opening and coke receiving cavity of the vehicle into which the coke is pushed. Such an enclosure has opposite sides generally parallel to the coke guide and an outer end wall generally parallel to the coke oven framing and a top wall surmounting the side walls and end wall. The inner ends of the side walls and top wall are positioned immediately adjacent to the coke oven framing so as to provide an enclosed atmosphere with respect to the incandescent coke and an associated enveloping steam atmosphere. Spray nozzles are provided on the interior of the aforesaid enclosure for discharging water toward the coke as it is pushed from the oven.

A principal step in the subject method includes delivering only a moderate amount of water toward the coke during extrusion. Parameters have been established for determining what constitutes an excessive or insufficient amount of water. Both the amount delivered and the manner in which it is delivered must be taken into consideration. An excessive quantity of water and resultant steam would have a damaging effect should steam be permitted to reach incandescent refractory brick in the coke oven. Also, excessive delivery of water will result in track flooding and/or ice formation impeding vehicle movement. The first of two considerations in determining minimal water needs is the necessity to develop a sufficiently enveloping steam atmosphere within the hood to suppress combustion. A second consideration in determining minimal water needs is the necessity to condition the upper layer of coke reposing in the vehicle for travel to the quenching location and in this regard both the quantity of water delivered and the orientation of sprays is significant. Such conditioning of the upper layer of coke reposing in the vehicle prevents the latent heat in the underlying coke from raising the upper layer of coke to an autoignition temperature during vehicle travel to the quenching station.

The enclosure steam is permitted to vent through an aperture located in the top or end wall of the enclosure so as to pass through a gas-cleaning duct wherein particulates are removed by a low-differential gas cleaning method such as inertial impaction. The particulate removing capability of a gas cleaner is enhanced by the wetting action of the steam atmosphere which causes particulates to increase in weight and/or agglomerate one to another. Therefore, the gas cleaning effect is enhanced by the same enveloping steam atmosphere which is previously used to suppress combustion and the inceptive formation of potential pollutants such as soot.

DETAILED DESCRIPTION OF A PREFERRED EMBODIMENT

Figure 1:
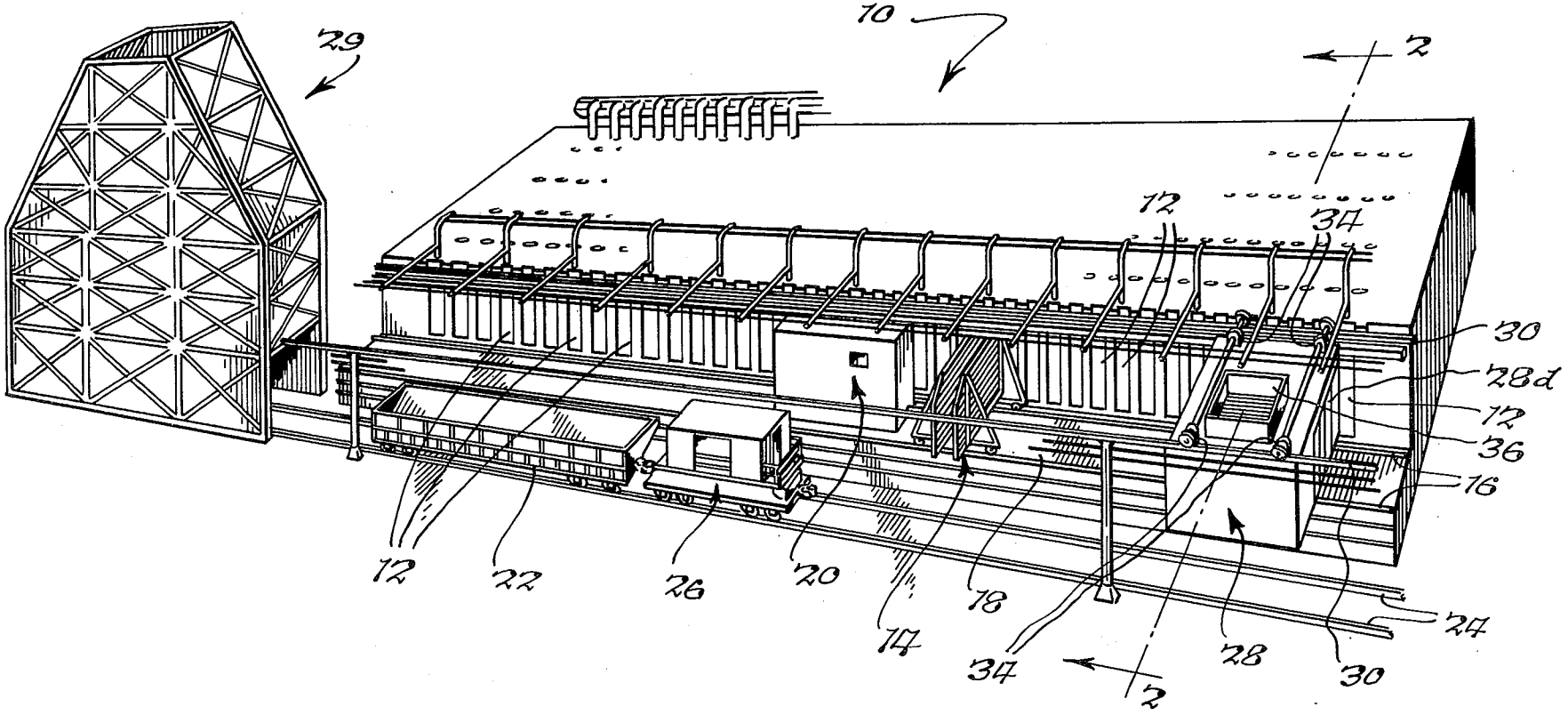
FIG. 1 is a perspective view illustrating the relative arrangement of a coke oven facility having a plurality of individual oven chambers therein adjacent to which the hood apparatus of the present invention is selectively positioned along the longitudinal length thereof and an open-topped vehicle which conveys extruded coke to a remotely located quenching station.

Referring now in detail to the perspective overview depicted in FIG. 1, there is shown a coke oven battery generally indicated at 10 having a plurality of oven chambers 12 extending transversely across battery 10 to the far side thereof and being separated from one another by intermediate cavity wall portions. A coke guide 14 is formed to include an upstanding tubular passage defined by oppositely disposed upstanding wall sections with overlapping, slotted sides. The coke guide 14 is moveable longitudinally along the front of the coke oven on guide rails 16 which are more clearly seen in detail in FIG. 2. Tracks 16 are mounted on a bench or platform 18 which extends laterally outward from the several coke oven chambers.

As is well known to those skilled in the art, a unit known as a coke oven chamber door extractor 20 is also mounted for movement along tracks 16 and is remotely operated to periodically remove one of the doors from the several oven chambers 12 so that the coke masses may be extruded therefrom into the coke guide 14. Such an extrusion takes place by means of applying an extrusion force on the far longitudinal side of battery 10 toward the coke guide to accordingly push the coke therethrough, all of which is well known.

As stated, the coke ejected through the output end of the coke guide breaks off and falls downwardly from the bench 18 into an open-top vehicle 22. Vehicle 22 is also moveable longitudinally along the battery 10 by its mounting on tracks 24 and is moved or positioned by a locomotive 26. Accordingly, it is well known to move the vehicle 22 to receive the coke from the coke guide and upon completion of an oven chamber push the vehicle 22 conveys the coke to a quenching station 29. As seen in detail in FIG. 2, the vehicle 22 includes an open top **22*a* and a reposing coke cavity 22*b*. In addition, the inclined bottom surface 22*c* of the vehicle is adapted to urge the coke through an exit in the lefthand wall portion of the vehicle. Such an exit is formed by selective opening of such side wall whereby quenched coke is urged by gravitational forces to slide downwardly along the inclinded bottom wall 22*c***. Where reposing coke is conveyed on a flat-bottom, open-top vehicle, quenched coke is discharged by causing the bottom to tilt.

The hood structure employed to practice the present invention is indicated at 28 in FIG. 1. The hood may be moved along an overhead trackway 30 to position it over the coke guide 14 prior to the latter receiving the ejected coke. As shown in FIG. 1, the door extractor 20 would first remove a door panel from oven chamber 12 and coke guide 14 would thereafter be aligned with the exposed oven chamber prior to extrusion of the coke therein towards such coke guide. Also prior to such extrusion, the hood 28 would be positioned over coke guide 14. In FIG. 1, the hood 28 includes a removeable wall portion **28*d* so that the hood 28 may be simply rolled down the tracks 30 to a position enveloping the coke guide with the removable side wall portion therein being replaced. However, it is to be understood that the longitudinal positioning of the hood 28 over coke guide 14 could be accomplished in a number of ways. The hood 28 could be suspended from a trolley-bridge crane arrangement so as to align the bridge with the coke guide and permit the trolley to move laterally over the coke guide, or the coke guide and hood 28 could be formed as an integral unit adapted to be positioned along the tracks 18** by a bridge and trolley crane.

Figures 2, 3:
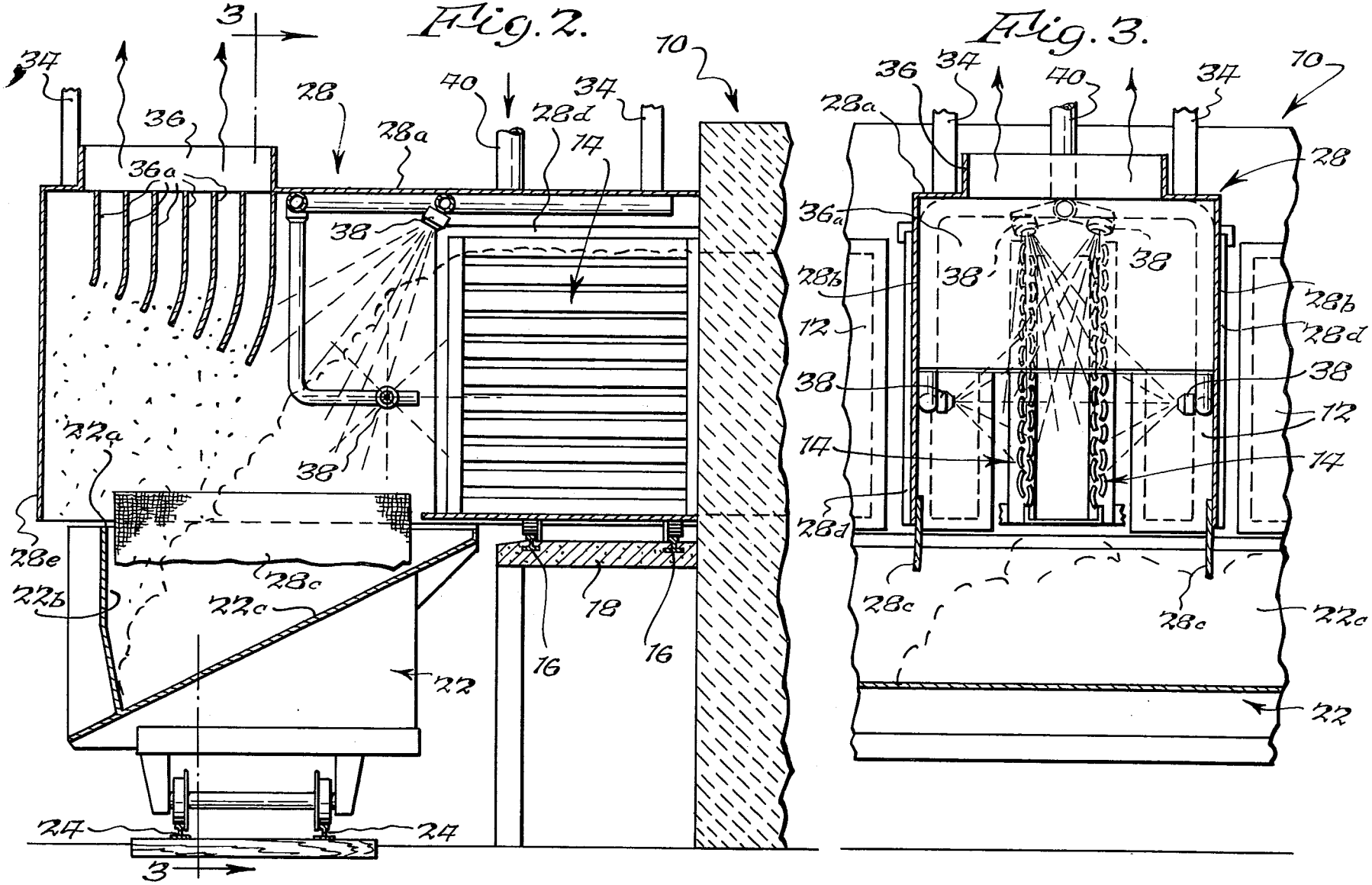
FIG. 2 is a side elevational view in section of the hood apparatus constituting the present invention with a vehicle disposed thereunderneath and the coke oven shown only in fragmentary portion as taken about line 2—2 of FIG. 1.
FIG. 3 is an end elevational view in section of the hood apparatus as taken about on line 3—3 of FIG. 2.

Accordingly, in FIGS. 2 and 3, the hood 28 is shown as resting on tracks supported by the strut members 34, the latter only being shown in broken, fragmentary form as being indicative of support provided the hood to maintain it in smoke tight engagement with the coke oven 10 along the edges of the top wall 28*a* and side walls 28*b* adjacent to the coke oven.

As further shown in FIGS. 2 and 3, a plurality of water spraying nozzles 38 are disposed about the interior surfaces of the hood 28 in a location laterally spaced from the coke oven corresponding to the lateral spacing of the coke guide outlet end from the oven. As shown the nozzles 38 are fed by an input pipe 40 and branch lines extending between said input pipe 40 and the respective nozzles 38. Although not shown, it has been further anticipated that various combinations of pumps and recirculating plumbing for the sprayed water would be utilized with the movable hood 28. More specifically, it has been considered that a water trough be hung from the stationary frame defining the oven chambers in a horizontal position above the top of the coke guide and the door extractor. By means of such a trough, pump suction pipes could be provided on the frame supporting the enclosure 28*a* so as to extend over and down into such a trough so as to be continually submerged therein regardless of which of the several positions the hood may be in along the longitudinal length of the trough. As will be described in more detail hereinbelow with respect to operation of the hood apparatus and practice of the method herein, water is sprayed through nozzles 38 onto coke pushed through the coke guide 14.

In regard to filling of the quenching car with coke, it is to be noted that the lower edges of the side walls 28*b*, being spaced apart less than the length of the car, are provided with flexible heat resistant curtains 28*c* which tend to prevent longitudinal escape of steam or particulate-laden smoke along cavity 22*b* of the vehicle as will be more clearly apparent in the description hereinbelow.

Necessarily, the spraying of water toward the hot coke as it falls into the vehicle 22 results in the creation of a steam atmosphere within the hood 28. In regard to the venting of the generated steam within the enclosure 28, a chimney or exhaust duct opening 36 is provided within the top or end wall of the hood at the outer edge thereof opposite from the coke oven 10. Exhaust duct 36 is formed to include provisions for a gas cleaner operating at a low-pressure differential such as an inertial impactor of a type shown as 36*a*. However, it is understood that gas cleaning could be accomplished by a variety of other methods such as electrostatic precipitation.

As stated hereinabove, the method and corresponding apparatus of the present invention operates to minimize the emission of particulate-laden smoke to the atmosphere during the interval of time beginning with delivery of incandescent coke from the coke oven 10 to an open-topped vehicle 22 and until the coke is delivered in such car to the point of actual quenching at station 29. Accordingly, the method and apparatus described herein are applicable to a quenching system remotely located from a plurality of coke oven chambers 12 servicing an open-top vehicle and such method and apparatus are therefore adaptable to the majority of existing coke processing facilities which are of this type.

In describing the operation of the present invention, such description will be with respect to a breaking cake of incandescent coke as normally extruded from a coke oven chamber 12. Normally, a coke oven battery 12 may be extruded four to six times per hour and each extrusion or "push" requires on the order of 35 to 40 seconds. At the time of the extrusion there is created an intense thermal updraft due to the heat of the coke which in turn carries with it particulate matter associated with the coke. The upward rise of this particulate-laden plume is mechanically thwarted initially by the physical confinement of hood 28. In addition to the thermal updraft just described, breaking of the coke cake at the end of the guide 14 has been known to include the exposure to atmosphere of uncarbonized volatile matter known as "greenness" in the coke which normally results in partial, uncontrolled combustion of such volatile matter. This condition of greenness is most often indigenous to batteries which have been in operation for a relatively large portion of their operating lifetimes as is well known to those in the coke industry. The spraying of the coke therefore in a predetermined manner is directed to both a suppression of combustion of the coke cake on its initial extrusion from a coke oven chamber and during a period of time necessary for conveyance of the coke in an open-top vehicle from the coke guide to a quenching station.

Although the initial thermal updraft and particulate matter entrained therein is prevented from passing directly to the atmosphere by the mechanical assembly of the hood, the exhaust duct opening 36 does provide for internal pressure release with respect to the hood as will more clearly appear hereinbelow, but only after substantially suppressing the amount of particulate matter which would otherwise pass to atmosphere.

A principal feature of the present invention resides in the fact that the water sprayed on the coke as it passes through the coke guide to the vehicle is of a limited quantity so as to insure suppression of combustion within the hood apparatus and as well as to the lower the surface or skin temperature of the coke in the upper layer of reposing coke to a sufficient point that upon conveyance to the quenching station the residual latent heat within the coke will not restore the coke surface temperature to its ignition point. Accordingly, it is to be understood that the introduction of water within the hood apparatus is not a quenching process but only a combustion suppression process whereby final quenching takes place at a remotely located facility as commonly practiced in the present state of the art.

For incandescent coke produced in a chamber being on the order of 17 to 19 inches wide, 9 to 10 feet high and 40 to 50 feet in length, the quantity of water for vaporization under the hood will be approximately one third of the quantity of water vaporized in traditional quenching. This is to be contrasted to normal quenching operations at a remotely located quenching station referred to hereinabove wherein a quantity of water on the order of 4500 gallons would be sprayed onto the aforesaid coke "push" and wherein only about 1500 gallons would be normally evaporated absent any surface temperature reduction as contemplated in the present invention. It is to be expected that the amount of water converted to steam in the final quenching will be slightly reduced in utilizing the present invention due to such limited reduction in the temperature of the top layer of reposing coke.

Upon the sprayed water within the hood absorbing heat from the incandescent coke as it passes from a coke oven chamber, the resultant steam immediately creates an enveloping atmosphere within the environment defined by the hood 28 which necessarily mixes with or absorbs the thermal updraft created by the intense heat of the coke. The steam atmosphere tends to preclude any potential combustion of the moving coke within the hood. Further, the enveloping steam atmosphere protects the hood itself from the heat radiating from the moving coke since the steam functions as a highly efficient radiant heat absorber. The protection of the hood from such radiant heat is to be distinguished from the evaporation of the sprayed water which absorbs the sensible heat from the surface of the upper layer of coke reposing in the vehicle. By such shielding of the hood from radiant heat, it is possible to construct the hood of lighter material than would be necessary if the hood walls were exposed to direct, non-shielded radiant heat from the coke.

In regard to the efficient production of steam within the hood, it has also been found desirable to spray warm water toward the coke and vehicle and to utilize an already warm vehicle for receipt of the coke so that steam will be more quickly developed within the hood and thereby insure suppresion of coke combustion therein. As stated, however, only a limited amount of water is sprayed in this manner.

In regard to venting of the steam atmosphere within the hood through the exhaust duct opening 36 referred to hereinabove, it has been found more effective to position such opening in the top wall 28*a* at the outer edge thereof opposite from the coke oven.

The continuous generation of steam during the extrusion of the coke continuously urges the steam to flow through the duct opening whereby the hood may self-vent. Indeed, it is considered that any induced draft other than that provided by the steam generation would tend to reduce the efficacy of the overall method.

In summary, the rapid creation of a steam atmosphere within the aforesaid enclosure during the extrusion of processed coke therethrough operates to suppress combustion of the extruded coke. Furthermore, the amount of particulate matter which is the residuum after the suppressive effects of the hood and the steam envelope is made amendable to gas cleaning methods such as inertial impactors of a type shown. In addition, the limited reduction in temperature of the surface of the reposing coke below its emission point is sufficient to avoid combustion thereof during transiting of the coke to a quenching station.

Having thus described and illustrated a preferred embodiment of the invention, it will be understood that such description and illustration is by way of example only and such modifications and changes as may suggest themselves to those skilled in the art are intended to fall within the scope of the present invention as limited only by the appended claims.

I claim:

1. In a coke air pollution control system for a coke oven having a plurality of oven chambers, the combination comprising:

means defining at least one vehicle having a reposing coke receiving cavity, a falling coke admitting opening communicating with said cavity and a self-unloading coke releasing exit communicating with said cavity, and said vehicle being adapted to travel between a coke receiving location and a coke quenching station, a coke guide having an inlet and adapted to receive an ejected coke mass from any of said coke oven chambers and an outlet and laterally spaced from said coke oven for guiding said ejected coke mass to fall through said coke admitting opening of said vehicle to said coke receiving cavity thereof, and a hood apparatus disposed above said vehicle means and along the front of said plurality of coke oven chambers, said hood apparatus comprising a top wall, end wall and oppositely disposed side walls, said end and side walls extending downwardly adjacent to the top of said vehicle and being connected together to envelop said coke guide and at least a portion of said coke admitting opening and coke receiving cavity of said vehicle, said hood being supported to maintain it in a substantially smoketight manner with said coke oven and said vehicle and further including liquid spraying means mounted on the interior surface thereof, supply means for supplying said spraying means with a liquid for the spraying thereof in predetermined quantities toward the mass of coke as it is ejected to thereby create substantially a vapor atmosphere within said hood and to reduce the temperature of the upper layer of reposing coke down to a preselected temperature range, said supply means supplying said liquid in quantities insufficient to quench said coke masses but sufficient to create said vapor atmosphere whereby particulate matter within said air space associated with said coke becomes wetted and entrained in said vapor, and an exhaust duct opening in said hood for venting said vapor and particulate matter entrained therein, said exhaust duct opening including means for removing wetted, entrained particulate matter from the vapor flow through said exhaust opening.

2. The combination according to claim 1 wherein said side walls of said hood are spaced apart a distance less than the length of said vehicle and include movable curtain means extending further downwardly from the lower edges thereof into said coke receiving cavity of said vehicle, and said end wall of said hood extends downwardly adjacent to the top of said vehicle and is spaced from the front of said coke oven a distance at least equal to the corresponding spacing of the outermost, upstanding wall of said vehicle from said coke oven.

3. The combination according to claim 1 wherein said exhaust duct opening is self-venting and disposed in said end wall of said hood and is formed to include a tortuous path so that particulate matter entrained within said vapor flow therethrough will be forced to impact on the surfaces of said duct and become deposited thereon.

4. The combination according to claim 1 wherein said exhaust duct opening is self-venting and disposed in said top wall of said hood and is formed to include a tortuous path so that particulate matter entrained within said vapor flow therethrough will be forced to impact on the surfaces of said duct and become deposited thereon.

5. The combination according to claim 4 wherein said exhaust duct opening is in said top wall portion outermost from said coke oven and said liquid spraying means are laterally spaced from said coke oven in a location corresponding to the lateral spacing of said coke guide outlet end therefrom.

6. The combination according to claim 1 including means operable to move said hood apparatus along the front of said coke oven so as to be selectively positioned adjacent to any one of said chambers therein.

7. The combination according to claim 2 wherein said spraying means are supplied with water and said exhaust duct opening is self-venting and disposed in said top wall of said hood and is formed to include a tortuous path so that particulate matter entrained within the steam flow therethrough will be forced to impact on the surfaces of said duct and become deposited thereon.

8. The combination according to claim 7 wherein said exhaust duct opening is disposed in said top wall portion at a position outermost from said coke oven and said fluid spraying means are laterally spaced from said coke oven in a location corresponding to the lateral spacing of said coke guide outlet end therefrom.

9. The combination according to claim 8 wherein said side walls of said hood are spaced apart a distance less than the length of said vehicle and include movable curtain means extending further downwardly from the lower edges thereof into said coke receiving cavity of said vehicle, and said end wall of said hood extends downwardly adjacent to the top of said vehicle and is spaced from the front of said coke oven a distance at least equal to the corresponding spacing of the outermost, upstanding wall of said vehicle from said coke oven.

10. The combination according to claim 9 wherein said coke guide and said hood are integrally connected one to another so as to be selectively positioned as a unit adjacent to any one of said coke oven chambers.

11. In a method for controlling air pollution associated with a coke oven having a plurality of oven chambers adapted to process a corresponding plurality of coke masses and wherein hot coke masses are ejected from said oven chambers through an inlet end of a coke guide and through an outlet end thereof laterally spaced from said coke oven to a vehicle means for transiting of said coke masses to a quenching station remotely located from said coke oven, the improvement comprising the steps of:

providing a hood to enclose within said hood in a substantially smoke-tight manner the air space extending over said coke guide and at least a portion of said vehicle means, spraying said hot coke masses upon passage to said vehicle means with a predetermined quantity of liquid insufficient to quench said hot coke masses but sufficient to create a vapor atmosphere within said enclosed air space whereby particulate matter within said air space associated with said coke becomes wetted and entrained in said vapor and combustion of said coke in said air space is substantially retarded, and providing a passage through said hood from said air space to ambient atmosphere for venting of said vapor and particulate matter entrained therein from said enclosed air space, said passage including means for removing said wetted, entrained particulate matter from the vapor flow through said passage.

12. The method as set forth in claim 11 wherein said passage is self-venting and is disposed at an upper portion of said hood and is formed to include a tortuous path so that particulate matter entrained within the vapor flow therethrough will be forced to impact on the surfaces of said passage and become deposited thereon.

13. The method as set forth in claim 12 wherein said passage is disposed in said hood upper portion at a position outermost from said coke oven and said coke is sprayed at a location laterally spaced from said coke oven corresponding to the lateral spacing of said coke guide outlet end therefrom.

14. A method as set forth in claim 11 wherein said sprayed liquid is water and wherein the temperature of the upper layer of coke reposing in said vehicle is lowered below its ignition temperature so that coke in said vehicle which is exposed to ambient atmosphere during transiting thereof to said quenching station will not be subject to combustion.

15. The method as set forth in claim 14 wherein said passage is self-venting and is disposed at an upper portion of said hood and is formed to include a tortuous path so that particulate matter entrained within the steam flow therethrough will be forced to impact on the surfaces of said passage and become deposited thereon.

16. The method as set forth in claim 15 wherein said passage is disposed in said hood upper portion at a position outermost from said coke oven and said coke is sprayed at a location laterally spaced from said coke oven corresponding to the lateral spacing of said coke guide outlet end therefrom.

* * * * *